United States Patent [19]

Jones

[11] 4,075,471

[45] Feb. 21, 1978

[54] LAMP ASSEMBLY

[75] Inventor: Kenneth James Jones, Sutton Coldfield, England

[73] Assignee: Lucas Electrical Company Limited, Birmingham, England

[21] Appl. No.: 620,791

[22] Filed: Oct. 8, 1975

[30] Foreign Application Priority Data

Oct. 17, 1974 United Kingdom ..... 45134/74

[51] Int. Cl.[2] ..... F21V 7/02

[52] U.S. Cl. ..... 362/300; 362/307; 362/310; 362/311

[58] Field of Search ..... 240/41.3, 41.1, 41.35 R, 240/41.35 E, 1.2, 7.1 R, 41.37, 41.36, 41.4, 106.1

[56] References Cited

U.S. PATENT DOCUMENTS

| | | | |
|---|---|---|---|
| 1,852,222 | 4/1972 | Stead | 240/41.1 |
| 1,898,143 | 2/1933 | Schensted | 240/41.1 |
| 2,147,679 | 2/1939 | Stanton et al. | 240/41.1 X |
| 2,592,075 | 4/1952 | Smith | 313/114 |
| 3,609,340 | 9/1971 | Habro | 240/41.1 |
| 3,634,675 | 1/1972 | Madsen | 240/1.2 |
| 3,752,408 | 8/1973 | Tixien | 240/41.1 |
| 3,766,373 | 10/1973 | Hedgewick | 240/8.3 |

FOREIGN PATENT DOCUMENTS

| | | | |
|---|---|---|---|
| 1,575,749 | 6/1969 | France | 240/41.36 |
| 1,036,086 | 4/1953 | France. | |

*Primary Examiner*—L. T. Hix
*Assistant Examiner*—W. J. Brady
*Attorney, Agent, or Firm*—Holman & Stern

[57] ABSTRACT

A lamp assembly has a housing of which part defines a parabolic or paraboloidal mirror and part defines part of an ellipsoidal reflector. A lamp filament is mounted at the inner focal point of the reflector and the focal point of the mirror coincides with the outer focal point of the reflector. The housing has a lens element defining a window through which light is directed from the mirror.

In one embodiment, an additional mirror and lens element are provided for receiving light from the reflector. The additional mirror directing the light in the opposite direction to the light directed by the first mentioned mirror.

In another embodiment, further mirrors are provided in the housing for increasing the horizontal spread of light.

10 Claims, 5 Drawing Figures

LAMP ASSEMBLY

This invention relates to a lamp assembly.

According to the present invention, there is provided a lamp assembly comprising a housing, an ellipsoidal reflector and bulbholder arrangement in the housing, a convex, parabolic or paraboloidal mirror in the housing positioned to receive light emanating, in use, from said arrangement, and a window in the housing, the convex mirror being disposed in the housing so that a focal point thereof lies on an outer focal point of the ellipsoidal reflector and so that, in use, it reflects a substantially parallel beam of light through the window.

By positioning the reflector and mirror in this way, a high intensity beam of light can be projected through the window. In the case of motor vehicle lamps, it is possible to use a smaller window size than has heretofore been necessary with motor vehicle lamps having merely a concave reflector mounted to direct light straight out of the window. Furthermore, there is less likelihood of external light entering the lamp via the window from being reflected back out of the window. Such an occurrence produces an apparent illumination of the lamp and is undesirable particularly where vehicle signal lamps are concerned.

In one embodiment, a further convex, parabolic or paraboloidal mirror is provided which faces in the opposite direction to the first-mentioned mirror and which has a focal point coincident with said focal point of the first-mentioned mirror.

A pair of additional concave parabolic or paraboloidal mirrors may be provided on either side of the or each convex mirror so that a wider lamp aperture is provided.

Figure 1:
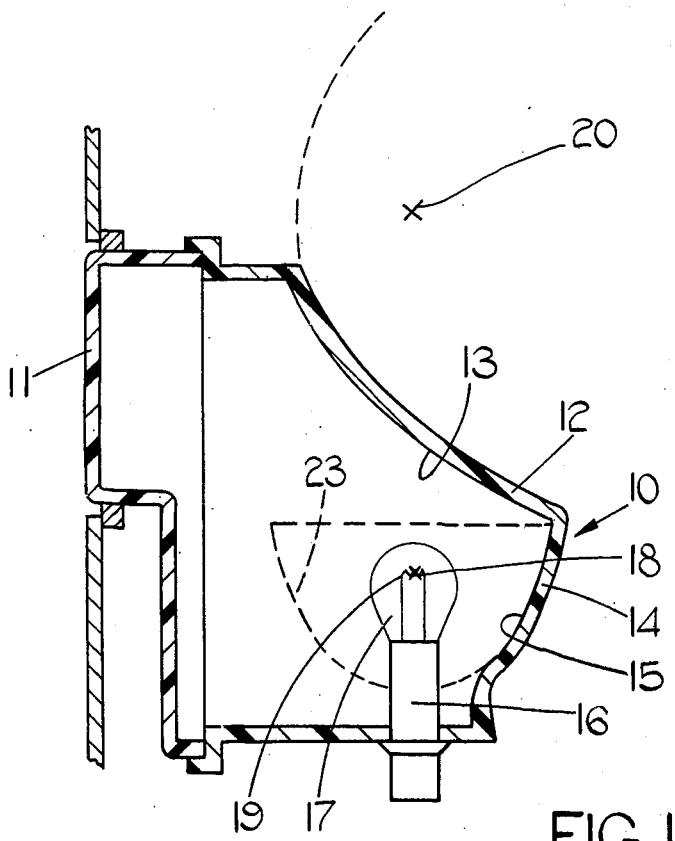
Figure 2:
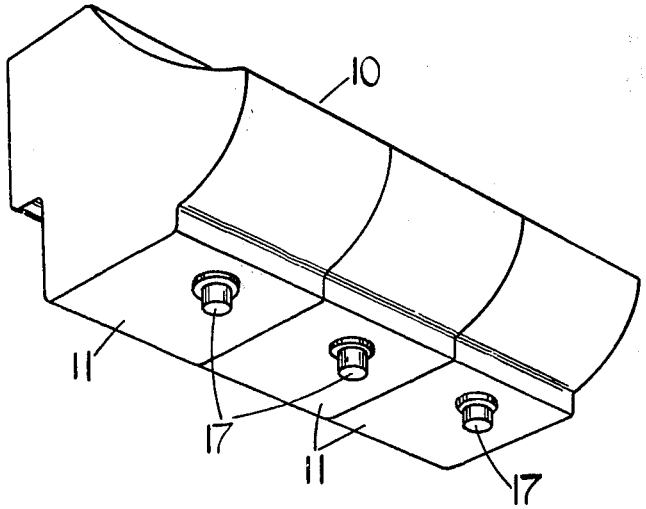
Figure 3:
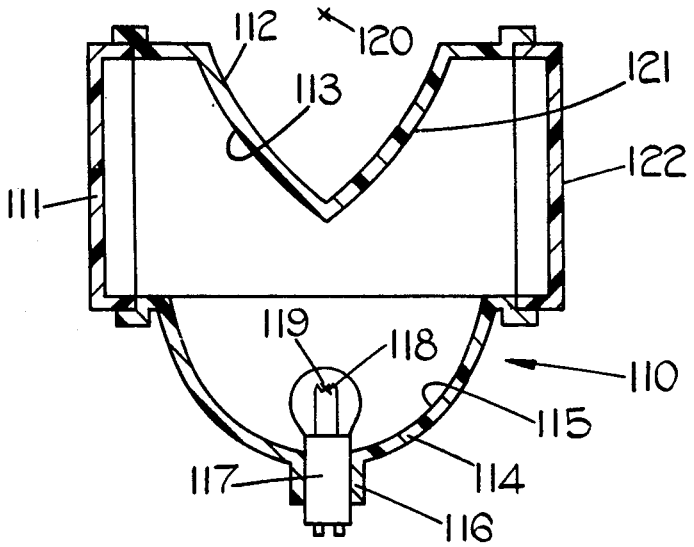
Figure 4:
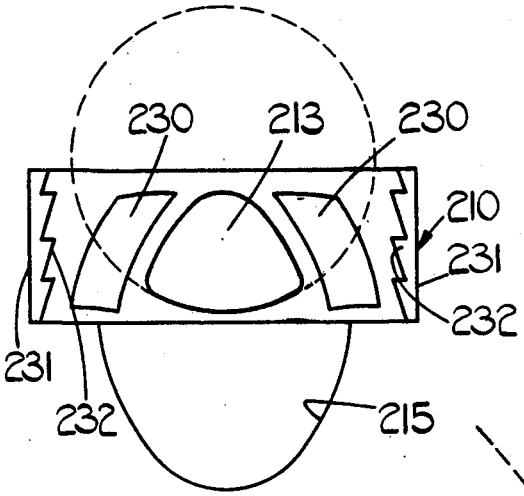
Figure 5:
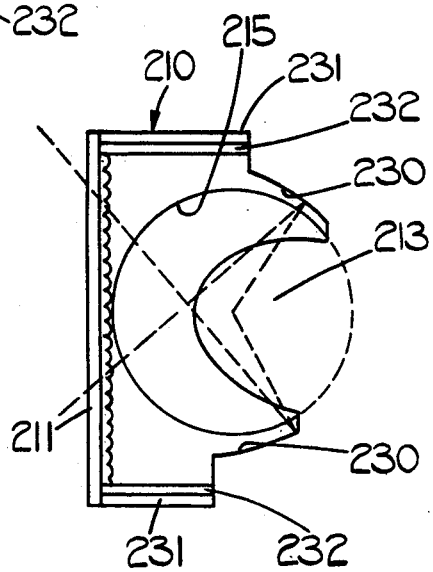

Embodiments of the present invention will now be described, by way of example, with reference to the accompanying drawings, in which:

FIG. 1 is a schematic cross sectional view of a lamp assembly according to the present invention for use as a motor vehicle rear lamp assembly, FIG. 2 is a schematic perspective view of the vehicle rear lamp assembly of FIG. 1, FIG. 3 is a schematic, cross sectional view of another lamp assembly according to the present invention, FIG. 4 is a schematic front view of a further form of lamp assembly according to the invention, and FIG. 5 is a schematic plan view of the lamp assembly of FIG. 4.

Referring to FIGS. 1 and 2 of the drawings, the vehicle rear lamp assembly comprises a composite housing 10 formed of a synthetic resin material and including an elongated rectangular light-transmitting lens or cover 11, defining a window, which is secured to the remainder of the housing 10. The remainder of the housing 10 is formed with a concavely curved portion 12 which is internally aluminised to provide a convex mirror 13 internally of the housing 10, the mirror 13 lying on the surface of a paraboloid. The housing 10 is also provided with a portion 14 which lies on the surface of an ellipsoid and which is internally silvered to define an ellipsoidal reflector 15. The reflector 15 has associated therewith a bulbholder 16 which is so positioned that a bulb 17 carried thereby has a filament 18 lying on an inner focal point 19 of the reflector 15.

The paraboloidal mirror 13 is positioned in the housing 10 so that the focal point 20 thereof coincides with an outer focal point of the reflector 15.

Referring now to FIG. 2 of the drawings, it will be seen that the vehicle rear lamp assembly is considerably extended in a longitudinal direction and, in fact, includes three reflector and bulbholder assemblies and three mirrors associated therewith. The light-transmitting cover 11 of the housing is divided into three sections of different colours so as to define a combined rear light and brake light, a direction indicator light, and a reversing light. Two of the above described vehicle rear lamp assemblies will be provided per vehicle.

In use, light from each arrangement of reflector 15 and bulb 17 will be directed towards the respective mirror 13 to be reflected thereby through the respective portion of cover 11, when the respective filament 18 is energised. The beam of light projected by each mirror 13 will be substantially parallel and fluting on the cover 11 provides any desired scattering, spreading or displacement of the beam.

With the above described lamp assembly, light external of the assembly, for example sunlight, entering the housing 10 through the cover 11 will tend to become 'lost' within the housing 10 because of the positioning of each mirror 13 with respect to the respective portion of cover 11. Furthermore, the concentrated beam of light reflected by convex mirror 13 permits a reduced area of lens 11 to be employed which is useful for styling purposes.

In a modification (not shown), the convex mirror 13 is provided with fluting thereon to provide a further modification and/or displacement of the light beam emanating therefrom.

In a further modification (as shown by broken line 23 in FIG. 1) the reflector 15 is reduced in size by removing the portion shown by dotted line 23. In this case, the overall height of the lamp assembly can be reduced which is again useful for vehcile styling purposes.

In order to reduce further the possibility of the lamp assembly appearing to be illuminated when external light is internally reflected, a neutral density material may be provided in or on the cover 11 as described in our co-pending British Patent Application No. 23264/74 filed on May 24, 1974.

In a further modification (not shown) when other than a parallel beam of light in the horizontal plane is required, the paraboloidal mirror 13 is replaced by a parabolic mirror having vertical and horizontal sections of different parabolic shape. In an extreme case, the mirrors have a constant parabolic cross-section so that the focus of such mirror is defined by a line. The outer focal point of the ellipsoid lies on the focal line of such convex mirror.

It will be seen from an examination of FIG. 1 of the drawing that the light only passes through a portion of the cover 11. If desired, only this portion of the cover 11 through which light passes need be formed of light transmitting material, the other portions of the cover being formed of a stronger or cheaper, opaque material. If the lamp assembly is being used as a rear lamp assembly for a vehicle, it is possible for a prismatic reflector to be provided on the outside of that portion of the cover 11 through which light is not intended to pass.

Referring now to FIG. 3 of the drawings, the lamp assembly illustrated therein is similar to that of FIG. 1 in that it is provided with an ellipsoidal reflector 115 whose shape is defined by a portion 114 of a synthetic resin housing 110 which has a further portion 112 defining the shape of a convex, paraboloidal mirror 113 internally of the housing 110, the portion 112 being internally aluminised to impart the required reflective properties. The portion 114 is provided with an integral bulbholder 116 which is so positioned that a bulb 117 carried thereby has a filament 118 lying on an inner focal point 119 of the reflector 115. As in the embodiment of FIGS. 1 and 2, paraboloidal mirror 113 has a focal point 120 which coincides with the outer focal point of reflector 115. A lens or cover 111 forming part of the housing 110 provides a window through which a concentrated beam of light is projected in use, in the manner described with reference to the embodiment of FIG. 1. However, in this embodiment, a further, convex paraboloidal mirror 121 is provided in back to back relationship with mirror 113. The focal point of mirror 121 coincides with the focal point 120 of mirror 113 and thus with the outer focal point of reflector 115. A further lens cover 122 is provided as part of the housing 110 and faces in the opposite direction to lens or cover 111.

In use, light emanating from filament 118 and reflector 115 is directed towards the two mirrors 113 and 121 so that some of the light is reflected forwardly by mirror 113 through cover 111 and the rest of the light is reflected through cover 122 by mirror 121.

The lamp assembly of FIG. 3 can be used, for example, as a direction indicator repeater lamp fixed to the side of a motor vehicle.

In a modification of the lamp assembly of FIG. 3, the paraboloidal portions defining mirrors 113 and 121 are integrally moulded with the covers 111 and 122 from a clear, transparent, synthetic resin material and the mirrors are formed by internal aluminisation. If a coloured light beam is required from one or each cover 111, 122, one or both is or are provided with a separate coloured filter or filters.

The modifications of the embodiment of FIGS. 1 and 2 described above may also be incorporated into the embodiment of FIG. 3.

Referring now to FIGS. 4 and 5 of the drawings, the lamp assembly illustrated therein is similar to that of FIG. 1 in that it is provided with an ellipsoidal reflector 215 whose shape is defined by part of the body 210 of the assembly, a paraboloidal mirror 213 whose shape is defined by another part of the body 210, and a rectangular cover 211 (see FIG. 5). The relationship between the reflector 215, the mirror 213 and the cover 211 is the same as that described with reference to the reflector 15, mirror 13 and cover 11 of FIG. 1.

However, in this embodiment, parts of the body 210 define a pair of concave paraboloidal mirrors 230 which are spaced apart horizontally on opposite sides of the mirror 213. The horizontal dimension of the mirror area exposed to light from the filament in reflector 215 is increased, so that a wider lamp aperture is provided. Furthermore, the internal surface of end walls 231 of the body 210 are aluminised and provided with flutes 232 thereon. These serve to increase further the angle of horizontal spread of light which angle may approach 180°. The flutes 232 extend horizontally from the front of the back of each end wall 231 and the inclination of the flutes 232 to the vertical increases from the bottoms to the tops of the end walls, 231.

The concave mirrors and/or the flutes may be applied to the embodiments of FIG. 1 and FIG. 3. In the case of the FIG. 1 embodiment, the fluting may also be applied to internal partitions separating the three different parts of the lamp assembly of FIG. 1 as well as to the end walls of the body.

I claim:

1. A lamp assembly comprising a housing, an ellipsoidal reflector and bulbholder arrangement in said housing, a convex mirror in said housing positioned to receive light emanating, in use, from said arrangement, and a window in said housing, said convex mirror lying on a paraboloidal surface formed by rotating a parabola about an axis which is perpendicular to a focal axis of said ellipsoidal reflector and being disposed in said housing so that a focal point of said parabola lies on an outer focal point of said ellipsoidal reflector, whereby, in use, said convex mirror reflects a substantially parallel beam of light through said window,

2. The lamp assembly according to claim 1, wherein a further convex mirror is provided in said housing, said further convex mirror facing in the opposite direction to the first-mentioned convex mirror, having a focal point coincident with said focal point of the first-mentioned convex mirror, and lying on a further paraboloidal surface formed by rotating a further parabola about said axis of rotation of the first-mentioned parabola.

3. The lamp assembly according to claim 1, wherein a pair of additional concave mirrors are provided on either side of said convex mirror.

4. The lamp assembly according to claim 1, wherein said ellipsoidal reflector is defined at least in part by a reflective layer applied to a part of said housing lying on an ellipsoidal surface.

5. The lamp assembly according to claim 1, wherein said convex mirror is defined at least in part by a reflective layer applied to a part of said housing lying on said paraboloidal surface.

6. A lamp assembly according to claim 1, wherein internal surfaces of end walls of said housing are coated with a reflective layer to increase the horizontal spread of light emanating, in use, from the assembly.

7. The lamp assembly according to claim 6, wherein, said internal surfaces are provided with fluting thereon.

8. The lamp assembly according to claim 1, wherein said window is formed as a light transmitting portion in an opaque cover closing an open front of said housing.

9. The lamp assembly according to claim 8, wherein a prismatic reflector is provided on said opaque cover.

10. A multiple lamp arrangement comprising a plurality of lamp assemblies according to claim 1, the housings of said lamp assemblies being common.

* * * * *